US007416081B2

(12) United States Patent
Sorrentino et al.

(10) Patent No.: US 7,416,081 B2
(45) Date of Patent: Aug. 26, 2008

(54) POWER TOOTHBRUSH DEMONSTRATION PACKAGE

(75) Inventors: Alan Sorrentino, Cranbury, NJ (US); Robert Moskovich, East Brunswick, NJ (US); Quang Nguyen, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 205 days.

(21) Appl. No.: 11/369,217

(22) Filed: Mar. 6, 2006

(65) Prior Publication Data

US 2006/0207901 A1 Sep. 21, 2006

Related U.S. Application Data

(60) Provisional application No. 60/659,231, filed on Mar. 7, 2005.

(51) Int. Cl.
*B65D 83/10* (2006.01)
*B65D 85/00* (2006.01)

(52) U.S. Cl. ..... 206/362.2; 206/459.1

(58) Field of Classification Search ..... 206/320, 206/361–362.2, 418–422, 459.1, 459.5, 730–735, 206/362.3; 446/73–76, 268
See application file for complete search history.

(56) References Cited

U.S. PATENT DOCUMENTS

| | | | | | |
|---|---|---|---|---|---|
| 217,933 | A | | 7/1879 | Folsom | |
| 254,840 | A | | 3/1882 | Perry | |
| 296,155 | A | | 4/1884 | Fish | |
| 712,189 | A | | 10/1902 | Gutmann | |
| 911,647 | A | | 2/1909 | Dougherty | |
| 1,118,824 | A | | 11/1914 | Spivy | |
| 1,453,672 | A | | 5/1923 | Heaton | |
| 1,483,195 | A | | 2/1924 | Pinkerton | |
| 1,550,687 | A | | 8/1925 | Gibson | |
| 1,758,568 | A | * | 5/1930 | Finley | 206/418 |
| 1,922,969 | A | | 8/1933 | MacColl | |
| 2,178,967 | A | * | 11/1939 | Markert | 206/418 |
| 2,195,495 | A | | 4/1940 | Popp | |
| 2,197,066 | A | | 4/1940 | Brody | |
| 2,219,183 | A | | 10/1940 | Hartnett et al. | |
| 2,322,057 | A | | 6/1943 | Poutinen | |
| 2,560,932 | A | | 7/1951 | Chapman et al. | |
| 2,612,260 | A | | 9/1952 | Schoenhut | |
| 3,430,364 | A | | 3/1969 | Kirschbaum et al. | |
| 3,682,344 | A | * | 8/1972 | Lopez | 206/459.1 |
| 3,762,545 | A | | 10/1973 | Warner et al. | |
| 4,098,577 | A | * | 7/1978 | Halpern | 206/459.1 |
| 4,398,212 | A | * | 8/1983 | Serry et al. | 206/320 |
| 4,458,435 | A | | 7/1984 | Ackerman | |
| 4,667,826 | A | | 5/1987 | Salacuse | |
| RE32,443 | E | | 6/1987 | Kalal | |
| 4,702,374 | A | * | 10/1987 | Kelner | 206/418 |

(Continued)

*Primary Examiner*—Bryon P Gehman
(74) *Attorney, Agent, or Firm*—Michael J. Wallace, Jr.

(57) ABSTRACT

A package that demonstrates a functionality of a contained product that has a demonstration feature distinct from the contained product that changes from a resting state to an active state upon activation of the contained product is described. In at least one configuration the product is a power toothbrush. In various instances the demonstration feature may be a movable medium. Among other things the movable medium may be agitated in the active state or may comprise various substances including one or more of sand, glitter, particles, powder filaments or fiber. A method of demonstrating the aforementioned functionality of a product, such as a toothbrush, is also described.

25 Claims, 5 Drawing Sheets

U.S. PATENT DOCUMENTS 4,723,656 A * 2/1988 Kiernan et al. ..... 206/459.1
4,800,666 A * 1/1989 Lukehart ..... 43/4
4,903,838 A 2/1990 Broers et al.
4,925,025 A 5/1990 Anten et al.
5,150,791 A 9/1992 Kamen et al.
5,188,222 A 2/1993 Pierce
5,494,252 A 2/1996 Amit et al.
5,635,229 A 6/1997 Ray
5,919,074 A * 7/1999 Honda ..... 446/268
6,126,008 A 10/2000 Cox
6,248,377 B1 6/2001 Levine
6,301,814 B1 10/2001 Baxter
6,520,339 B1 2/2003 Conway, Jr.
6,629,609 B2 10/2003 Cook et al.
6,727,826 B1 * 4/2004 Ki Kwan et al. ..... 340/825.72
6,749,437 B2 * 6/2004 Chan ..... 206/459.1
6,773,062 B2 8/2004 Illulian
7,059,471 B2 * 6/2006 Fattori ..... 206/362.3
2001/0035368 A1 11/2001 Carr
2002/0038772 A1 4/2002 Blaustein et al.
2003/0217489 A1 11/2003 Witkowski
2004/0045204 A1 3/2004 Miano et al.
2004/0187370 A1 9/2004 Buzby
2005/0076533 A1 4/2005 Huston et al.

* cited by examiner

POWER TOOTHBRUSH DEMONSTRATION PACKAGE

This application claims the benefit of U.S. application Ser. No. 60/659,231, filed Mar. 7, 2005, the content of which are incorporated by reference herein.

FIELD OF THE INVENTION

The present invention relates to packaging in general, and more particularly to a toothbrush package that demonstrates the functionality of a toothbrush contained within.

BACKGROUND

Many packages have interactive features that demonstrate product features or functionality. A simple example is a "scratch-n-sniff" patch applied to an outer package surface that is representative of the scent of a product contained within. Another example is an opening in a package that provides access to an actionable part of the product, or a "try me" feature that allows a consumer to temporarily activate the product through the packaging.

In each of the above examples, the packaging structure passively conveys product functionality. In the "scratch-n-sniff" patch example, the packaging acts only as a support for the patch. A "try me" feature on a package for a vibrating-head power toothbrush, for example, activates the head vibrations, which are transmitted though the packaging to the user's hand, with the packaging functioning only as a vibration conduit and nothing more.

While such packaging examples serve to passively educate the consumer, the packaging structures fail to interact with the product to create an amplified, dynamic experience for the consumer. There is a need, therefore, to provide a package that demonstrates product functionality in a dynamic, eye-catching manner.

SUMMARY

A package that demonstrates a functionality of a contained product, the package comprising a demonstration feature distinct from the contained product that changes from a resting state to an active state upon activation of the contained product. In one embodiment, a package for a powered toothbrush having a vibrating portion is provided with a demonstration feature in the form of a liquid filled capsule at least partially surrounding the vibration portion. When the toothbrush is powered in the package, by a consumer activating a "try me" feature or the like, the liquid in the capsule vibrates vigorously to illustrate the vibration generated by the packaged toothbrush. The sensorial experience to the consumer is amplified, first in the form of vibrations felt through the package, and second in the form of vibrations generated in the demonstration feature included in the package. Thus, the packaging dynamically interacts with the product to provide a multi-sensorial demonstration of product functionality at the point of purchase.

DETAILED DESCRIPTION OF THE PREFERRED EMBODIMENTS

Figure 1:
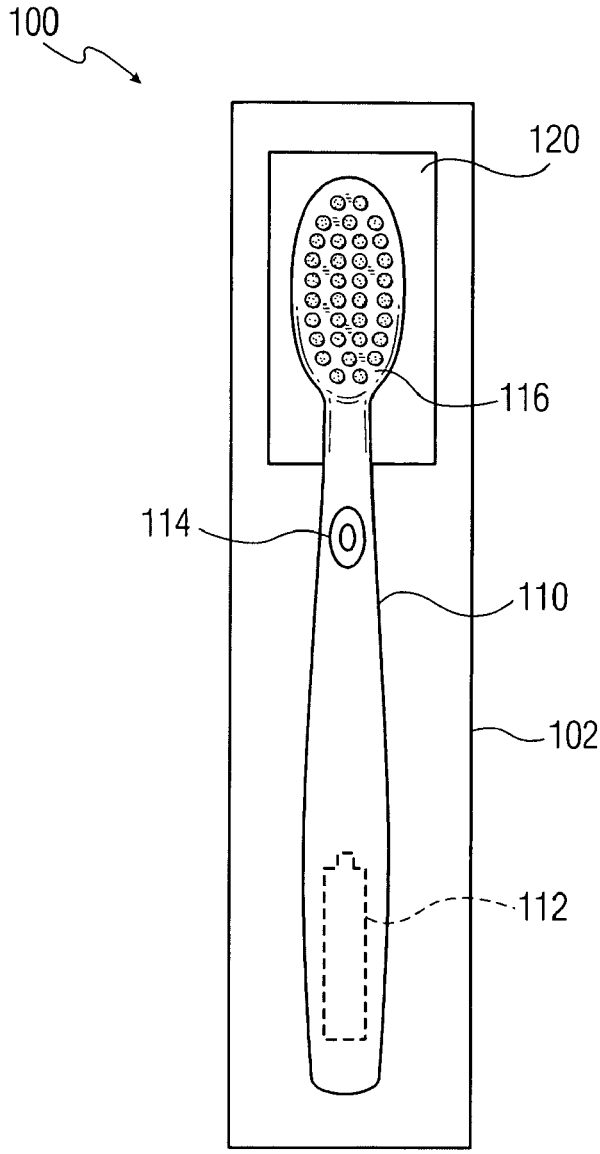
FIG. 1 is one embodiment of a demonstration package of the present invention.
Figure 2:
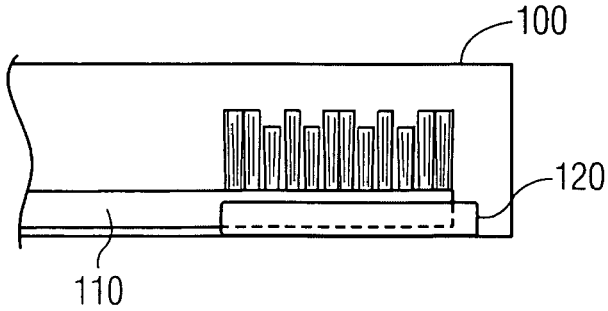
FIG. 2 is a partial side view of a portion of FIG. 1.
Figure 3:
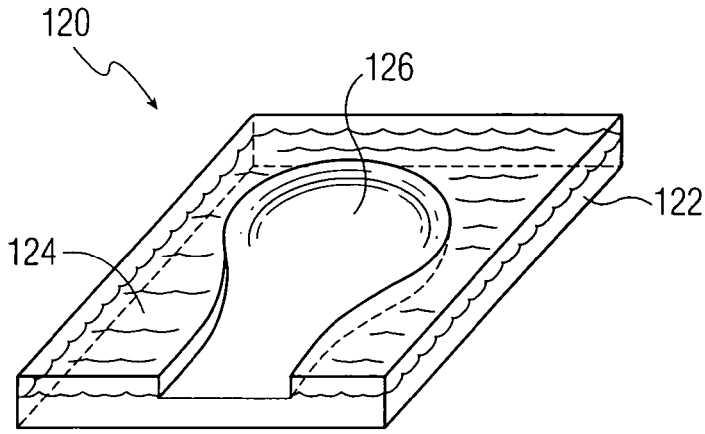
FIG. 3 is a close-up view of a demonstration feature of FIG. 1.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIGS. 1-5 illustrate one embodiment of a package 100 including a product 110 and a demonstration feature 120 that demonstrates a functionality of the product 110 when the product 110 is activated within the package 100. In the embodiment of FIG. 1, product 110 is a power toothbrush having a power source 112 in a handle 114, a switch 114 for activating the power source 112, and a head 116 that vibrates upon activation of the power source 112. It will be appreciated that while the present embodiment is described and illustrated using a power toothbrush with a particular power source and switch configuration, a variety of other power toothbrushes or products other than toothbrushes could be utilized. Thus, the description and illustration of a power toothbrush is used for purposes of convenience in a non-limiting manner.

Figure 4:
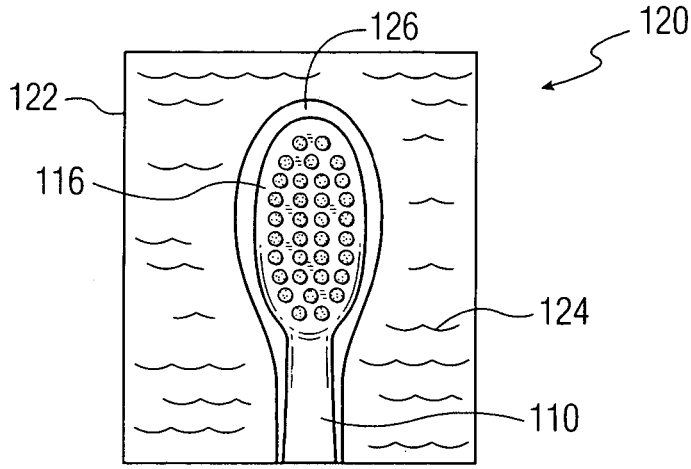
FIG. 4 is a front view of a toothbrush head in the demonstration feature of FIG. 3 in the resting state.
Figure 5:
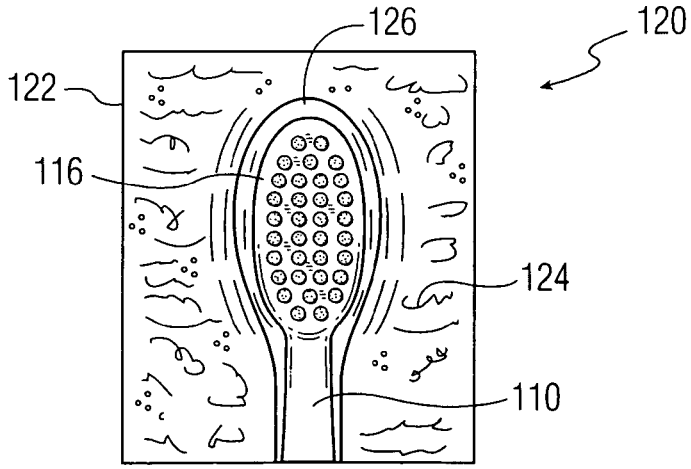
FIG. 5 illustrates the demonstration feature of FIG. 4 in the active state.

Head 116 is preferably positioned in the package 100 adjacent demonstration feature 120 to effectively communicate the head vibrations through the demonstration feature 120 as will be described below. As will also be described, the positioning of the demonstration feature 120 relative to the product 110 could vary as desired. In the present embodiment, demonstration feature 120 is a capsule 122 filled with a movable medium 124 such as, for example, a clear liquid. Head 116 is preferably accommodated within a socket 126 in the capsule 122 so that the capsule 122 partially surrounds the head 116. In a resting state as shown in FIG. 4, the liquid 124 in the capsule 122 is relatively quiescent and may assume a clear, transparent appearance. When a consumer activates the toothbrush 110 within the package 100 causing the head 116 to vibrate, via a "try me" feature associated with the switch 114 for example (not shown), the demonstration feature 120 transitions to an active state, with the head vibrations causing the liquid 124 in the capsule 122 to become agitated and vibrate, splash and/or bubble, creating a multi-sensorial experience for the consumer as shown in FIG. 5. Thus, the demonstration feature 120 visualizes the vibrations emitted from the 110, thereby amplifying the sensorial experience beyond the sense of touch (i.e., head vibrations felt through the walls 102 (FIG. 1) of the package 100) and into the sense of sight and/or sound through an agitation of the medium 124.

Capsule 122 is preferably a thermoformed plastic capsule filled completely or partially with a movable medium to visually demonstrate a functionality of the packaged product.

More preferably, the movable medium is a non-toxic liquid, although other gaseous or particulate-type mediums may be used such as, but not limited to sand, glitter particles, powder, filaments, fibers, etc. alone and/or in combination with the liquid. The liquid may be clear or colored and have any desired consistency, with the understanding that certain mediums may provide a greater visual experience than others depending on the product, the product functionality and the type and magnitude of the product functionality being demonstrated. Of course, vibration or other types of product functionality could be demonstrated by something other than a capsule per se, so long as the product functionality is visually apparent from inspection of the package.

Figure 6:
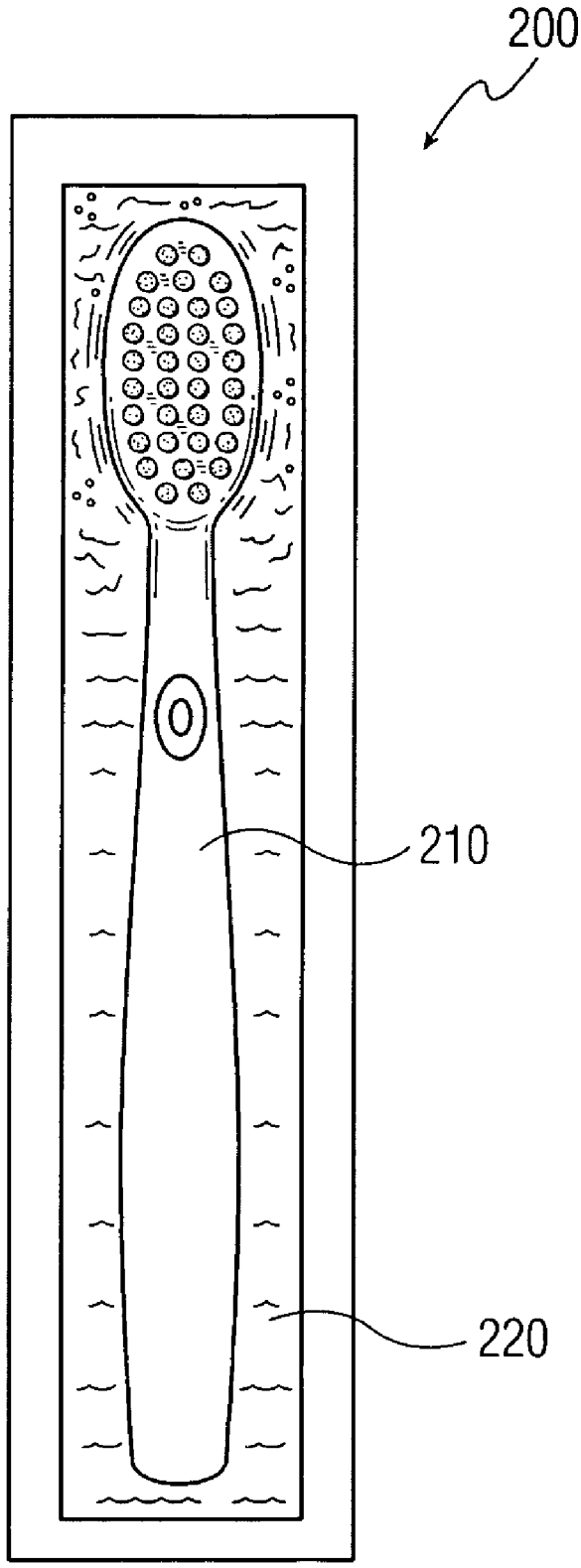
FIG. 6 illustrates a further embodiment of a demonstration package of the present invention.

Capsule 122 can be a separable from or formed integrally with the package 100. For example, the capsule 122 and package 100 could be formed in a single molding operation, or the capsule could be attached to and detachable with the product from the package. Any manner of associating the product, package and demonstration feature will be contemplated. For example, the capsule 122 could simply surround the product instead of including a socket 126 to receive a portion of the product. The demonstration feature could also be any shape or size as desired. In the package 200 of the embodiment of FIG. 6, for example, a demonstration feature 220 could completely surround the periphery of a product 210 such that, as compared with the embodiment of FIGS. 1-5, the vibrations would be visualized around the entirety of the product 210 and not just localized around the portion of the product 210 that generates the most vibration. Demonstration feature 220 could be formed as, for example, an integral part of the package 200 or as an insert disposed between the product 210 and the rear of the package 200, or the like. Demonstration feature 220 could also be provided with a socket, in a manner similar to socket 126 of FIG. 3, which accommodates the packaged product.

Figure 7:
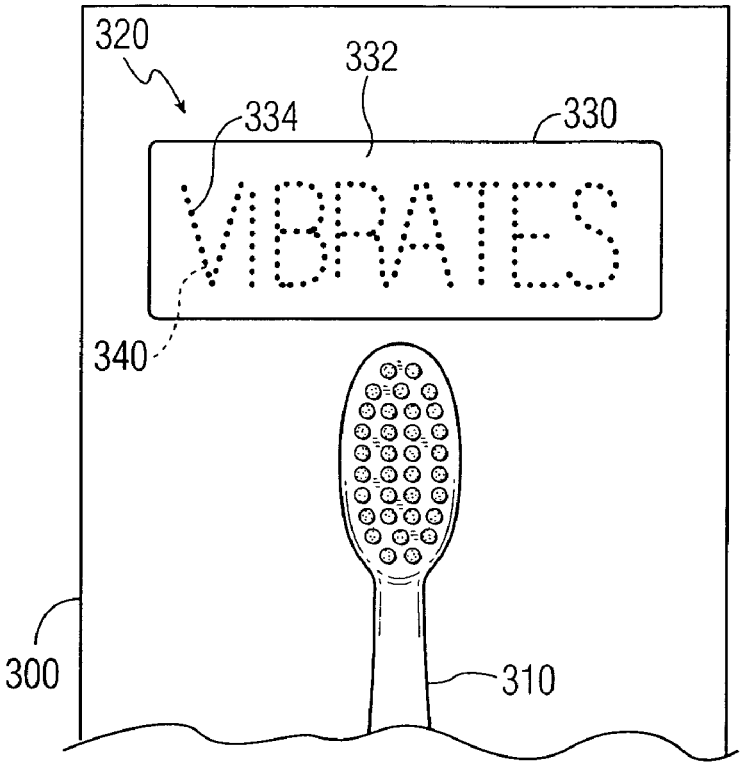
FIG. 7 illustrates yet a further embodiment of a demonstration package of the present invention in the resting state.
Figure 8:
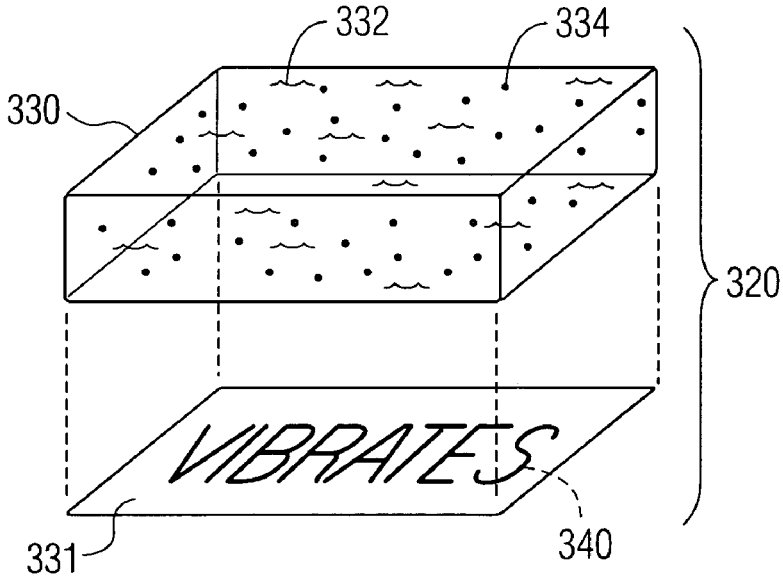
FIG. 8 illustrates an exploded view of the demonstration feature of FIG. 7.
Figure 9:
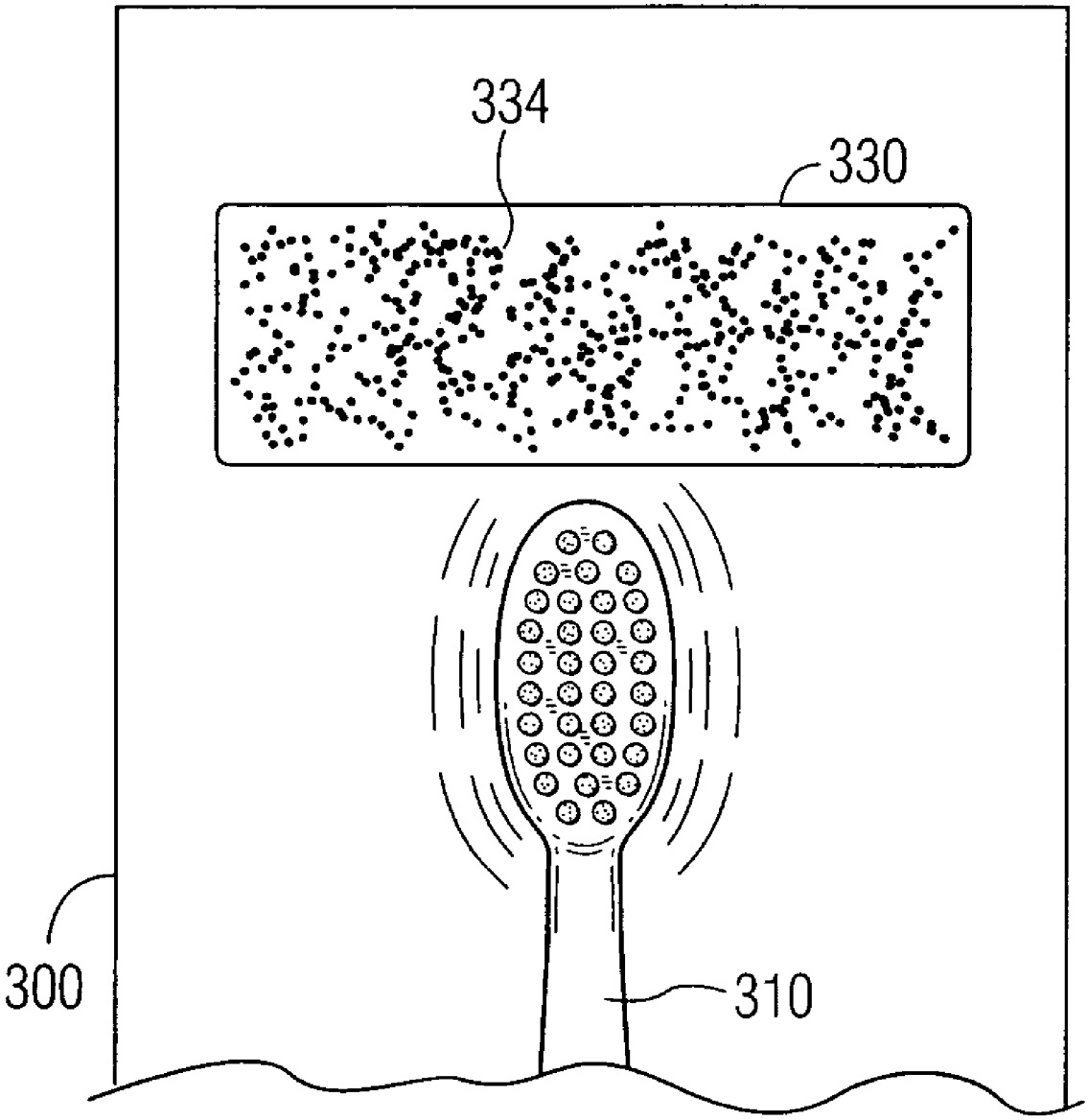
FIG. 9 illustrates an the demonstration feature of FIG. 7 in the active state.

FIGS. 7-9 illustrate a further embodiment of a package 300 for a product 310 having a demonstration feature 320 that could also be configured to visually communicate a functionality of the product 310 in both the rest and active states. Demonstration feature 320 comprises a capsule 330 that is provided on one surface 331 with a magnetized strip or a plurality of strips 340 arranged to form a message, such as "VIBRATES." The strip(s) 340 is preferably provided either on the rear surface 331 of the capsule 330 (FIG. 8) or on the package 300 adjacent the capsule such that it is not visible to the customer upon inspection of the capsule 330. However, as shown in FIG. 7, the capsule 330 is filled with a mixture of clear liquid 332 and magnetic particles 334 such that, in the resting state, the magnetic particles 334 are attracted to the field created by the strip(s) 340 and align to create the message formed by the arrangement of the strip(s) 340. Upon activation of the product 310 as shown in FIG. 9, or in this embodiment a toothbrush with a vibrating head, the demonstration feature 320 enters the active state, which results in an agitation of a magnitude that overcomes the magnetic attraction between the particles 334 and strip(s) 340 to such an extent that the particles 334 are no longer aligned with the strip(s) 340 and instead form a cloud of vibrating particles in the clear liquid 332. Deactivation of the product 310 causes the demonstration feature 320 to assume the resting state, whereby the particles 334 become realigned into a communicative message.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A package that demonstrates a functionality of a contained product, wherein the contained product is a power toothbrush, the package comprising a demonstration feature distinct from the power toothbrush that changes from a resting state to an active state upon activation of the power toothbrush.

2. The package of claim 1, wherein the active state is visually representative of the functionality of the power toothbrush.

3. The package of claim 1, wherein the demonstration feature further comprises a movable medium.

4. The package of claim 3, wherein the movable medium further comprises a liquid that becomes agitated in the active state.

5. The package of claim 4, wherein the movable medium further comprises one of sand, glitter, particles, powder, filaments and fibers.

6. The package of claim 3, wherein the movable medium further comprises one of sand, glitter, particles, powder, filaments and fibers.

7. The package of claim 6, wherein the movable medium further comprises magnetic particles that are communicative in the resting state.

8. The package of claim 1, wherein the demonstration feature is integral with the package.

9. The package of claim 1, wherein the demonstration feature is removable from the package.

10. The package of claim 1, wherein the demonstration feature is a liquid-filled capsule.

11. The package of claim 10, wherein the demonstration feature surrounds at least a portion of the power toothbrush.

12. The package of claim 11, wherein the demonstration feature surrounds the power toothbrush.

13. The package of claim 1, wherein the demonstration feature further comprises a socket to accommodate at least a portion of the power toothbrush.

14. The package of claim 1, wherein the power toothbrush further comprises a powered element, and wherein the demonstration feature is situated near the powered element.

15. A method of demonstrating power toothbrush functionality comprising the steps of: a) providing a package including a contained power toothbrush with a functionality; b) providing a demonstration feature in the package that has a resting state and an active state; c) activating the contained power toothbrush within the package; and d) changing the demonstration feature from the resting state to the active state to demonstrate the functionality the demonstrative feature further comprising a movable medium that becomes agitated in the active state.

16. The method of claim 15, wherein the demonstration feature further comprising a liquid-filled capsule.

17. A package that demonstrates a functionality of a contained product having a power source and a portion that moves upon activation of the power source, the package comprising a demonstration feature distinct from the contained product that changes from a resting state to an active state upon activation of the power source of the contained product, the demonstration feature comprising a moveable medium including a liquid that becomes agitated in the active state.

18. The package of claim 17, wherein the movable medium further comprises one of sand, glitter, particles, powder, filaments and fibers.

19. A package that demonstrates a functionality of a contained product having a power source and a portion that moves upon activation of the power source, the package comprising a demonstration feature distinct from the contained product that changes from a resting state to an active state upon activation of the power source of the contained product, the demonstration feature comprising a moveable medium including one of sand, glitter, particles, powder, filaments and fibers.

20. The package of claim 19, wherein the movable medium further comprises magnetic particles that are communicative in the resting state.

21. A package for a contained product that provides a multi-sensorial experience comprising: a) a product having a power source and a portion that generates a first sensorial experience upon activation of the power source of the product within the package; and b) a demonstration feature that changes from a resting state to an active state upon activation of the power source of the product, the active state generating a second sensorial experience that is different from the first sensorial experience, wherein at least one of the first and second sensorial experiences relates to the sense of touch.

22. The package of claim 21, wherein at least one of the first and second sensorial experiences relates to the sense of sight.

23. The package of claim 22, wherein the product is a toothbrush and the demonstration feature comprises a movable medium.

24. The package of claim 23, wherein the demonstration feature is a liquid-filled capsule.

25. The package of claim 21, wherein one of the sensorial experiences is represented by an agitated medium.

* * * * *